US009194622B2

(12) United States Patent
Arslankiray et al.

(10) Patent No.: US 9,194,622 B2
(45) Date of Patent: Nov. 24, 2015

(54) COOLING DEVICE HAVING A MOVABLE CONTAINER

(71) Applicant: BSH BOSCH UND SIEMENS HAUSGERATE GMBH, München (DE)

(72) Inventors: Ziya Arslankiray, Tekirdag (TR); Cemalettin Hastürk, Tekirdag (TR); Mehmet Seval, Istanbul (TR)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/459,461

(22) Filed: Aug. 14, 2014

(65) Prior Publication Data

US 2015/0054395 A1 Feb. 26, 2015

(30) Foreign Application Priority Data

Aug. 21, 2013 (TR) ..... a 2013 09987

(51) Int. Cl.

| | |
|---|---|
| ***F25D 25/00*** | (2006.01) |
| ***F25C 5/18*** | (2006.01) |
| ***F25C 5/00*** | (2006.01) |
| ***F25D 25/02*** | (2006.01) |

(52) U.S. Cl.

CPC ..... *F25C 5/182* (2013.01); *F25C 5/005* (2013.01); *F25D 25/025* (2013.01)

(58) Field of Classification Search

CPC ... F25D 25/025; F25D 23/005; F25D 25/002; F25D 25/021; A47B 2210/175

USPC ..... 312/404, 408, 330.1; 62/344, 382

See application file for complete search history.

(56) References Cited

U.S. PATENT DOCUMENTS

| | | | | |
|---|---|---|---|---|
| 2,544,394 | A * | 3/1951 | Muffly | 62/267 |
| 2,724,628 | A * | 11/1955 | Schrader | 312/270.3 |
| 2,755,158 | A * | 7/1956 | Davidson | 312/404 |
| 2,955,440 | A * | 10/1960 | Erickson et al. | 62/301 |
| 3,266,858 | A * | 8/1966 | Klotz | 312/270.3 |
| 3,776,504 | A * | 12/1973 | Wiley | 249/121 |
| 4,285,212 | A * | 8/1981 | Prada | 62/344 |
| 4,501,456 | A * | 2/1985 | Schafer | 312/273 |
| 4,732,435 | A * | 3/1988 | Bailey et al. | 312/311 |
| 5,157,940 | A * | 10/1992 | Bertu et al. | 62/382 |
| 5,997,118 | A * | 12/1999 | McBrayer et al. | 312/334.44 |
| 8,152,255 | B2 * | 4/2012 | Nam et al. | 312/404 |
| 2008/0272679 | A1 * | 11/2008 | Wuesthoff | F25C 5/005 312/404 |
| 2009/0309472 | A1 * | 12/2009 | Park et al. | 312/401 |
| 2011/0018412 | A1 * | 1/2011 | Swanek | 312/249.11 |
| 2011/0314860 | A1 * | 12/2011 | Tafoya et al. | 62/344 |
| 2012/0227421 | A1 * | 9/2012 | Kim | F25C 5/187 62/66 |
| 2013/0300276 | A1 * | 11/2013 | Nuss | 312/404 |
| 2015/0184918 | A1 * | 7/2015 | Klingshirn | F25D 17/062 62/186 |

* cited by examiner

*Primary Examiner* — Janet M Wilkens

(74) *Attorney, Agent, or Firm* — Nixon & Vanderhye P.C.

(57) ABSTRACT

A cooling device includes a chilled chamber; and a container movably disposed in the chamber and having a wall. The chamber has a prevention element disposed on a wall of the chamber and having a lower edge being close to an upper edge of the wall of the container such that the movement of the container below the prevention element is possible and drop of an item in the container over the wall of the container is prevented.

20 Claims, 4 Drawing Sheets

A-A

COOLING DEVICE HAVING A MOVABLE CONTAINER

This application claims priority to TR Patent Application No. 2013/09987 filed 21 Aug. 2013, the entire content of which is hereby incorporated by reference.

TECHNICAL FIELD

The present invention relates to a cooling device comprising a chamber being chilled; a container movably disposed in the chamber and having at least one wall.

KNOWN STATE OF THE ART

A cooling device, particularly a refrigerator, comprises a chamber where the items disposed therein are kept cool. There may moreover be a container inside the chamber. In some cooling devices, said container may be movable. For instance, the container may be drawn frontally in the form of a drawer, and it may be pushed back to the prior position thereof. In another example, the container may be fixedly positioned inside a drawer, and it may move together with the drawer. If the items (for instance, food, etc.), which exist inside the movable containers, are accumulated at a height close to the walls of the container, the items may drop over the container during movement.

In some cooling devices, particularly in refrigerators with bottom freezer, there is an ice making unit at a certain point of the chamber. The ice, formed in the ice making unit, is presented to the user by means of pluralities of methods.

According to one of these methods, a container is positioned under the ice making unit in passive position. The formed ice is transferred to the container manually or automatically. When ice is desired to be taken from the container, the container is drawn like a drawer, and it is brought to an accessible position. When ice is taken manually or by means of an ice scoop, the ice pieces are accumulated in the rear section of the container. Sometimes, the ice pieces can rise to a point which is higher than the container wall. In this case, while the container is being brought to the position inside the chamber or after the container is brought to said position, the accumulated ice pieces may drop over the container. The dropped ice pieces may lead to pluralities of problems. For instance, the dropped ice pieces may prevent the complete closing of the drawer.

In order to prevent this problem, in the related art, there is the patent application with publication number US2011314860A1. Accordingly, in an ice chamber comprising at least one side wall and rear wall, protection surfaces, which are rotatable around an axis, are embodied. The protection surfaces can realize axial rotation between a lower position and a higher position with respect to the chamber. The protection surfaces prevent the ice pieces from dropping over the rear section of the chamber while the freezer drawer is being opened or closed.

The present invention brings an additional improvement, additional advantage or an alternative to the abovementioned present art.

OBJECT OF THE INVENTION

The main object of the present invention is to provide a cooling device preventing the item or items, provided in a container of the cooling device, from exceeding the wall or walls of the container and from falling over the container during use.

In order to realize said object, the present invention relates to a cooling device comprising a chamber being chilled; a container movably disposed in the chamber and having a wall. The present invention is characterized in that the chamber comprises a prevention element disposed on a wall of the chamber and having a lower edge being close to an upper edge of the wall of the container such that the movement of the container below the prevention element is possible and drop of an item in the container over the wall of the container is prevented. Thus, an item, reaching a point which is higher than the upper edge of the container wall, is guided into the container by the lower edge of the prevention element during movement of the container. By means of this, said item is prevented from being at a position which permits it to drop over the container wall.

Said cooling device may be a domestic refrigerator and/or freezer. The wall or walls of the cooling device may be heat insulated. The chamber may be a cooling chamber or a freezing chamber of a refrigerator. For instance, it may be a refrigerator where the freezing chamber is provided above and/or under the cooling chamber. The refrigerator may have only one door or it may have two doors. The door of the freezing chamber can make pivotal movement (for instance, it may be hinged, etc.) or it may be opened in a sliding manner.

The container can move in any direction inside the cooling device. For instance, it may move frontally and backwardly like a drawer. On the other hand, it may move right-left and/or upwardly-downwardly in the form of a container whose position is adjustable. The container may have at least one wall. For instance, it may be a container comprising a base wall, two side walls, a front wall and a rear wall.

The prevention element may be positioned on any wall of the chamber so as to form a volume for the movement of the container thereunder. Probable chamber wall may be a rear, side, lower and/or upper chamber wall.

The lower edge of the prevention element is close to the upper edge of the container wall as much as possible in a manner permitting movement of the container. Thus, the risk of an item passing between the two edges can be reduced.

The item provided inside the container may be a foodstuff. For instance, it may be vegetable and/or fruit. In a probable embodiment where the container is an ice chamber, the item may be ice pieces.

In a probable embodiment of the present invention, the wall of the container is a rear wall and/or a side wall of the container. Thus, a wall, which is difficult to access by the user, can be kept under control. Moreover, the item can be prevented from dropping into a region like the back region inside the chamber which is difficult to access.

The container wall may be a wall which is orthogonal with respect to the movement direction depending on the movement of the container. For instance, it may be the rear wall in a container moving frontally and backwardly. On the other hand, in a container moving to the right and/or to the left, it may be the right or left wall.

In a probable embodiment of the present invention, the prevention element comprises a prevention wall having the lower edge. Thus, even an item which is at a greater height than the height level of the upper edge of the container wall can be guided into the container without dropping from the container by means of the prevention wall. For instance, the prevention element may comprise a prevention wall extending from the chamber wall up to the upper edge of the container wall. Thus, all items which may drop over the container wall can be kept inside the container.

The prevention element and optionally the prevention wall may be a plate formed. The plate may be provided so as to have strength such that it is not deformed by an item (for instance, vegetable, fruit, ice, etc.) which is probably disposed into the container.

In a probable embodiment of the present invention, the prevention wall comprises a recess compliant with an edge of a door of the cooling device in form. Thus, the prevention element can be fixed to the position which is closest with respect to the opening of the chamber closed by the door. The reason of this is to make possible earliest intervention to the related wall of the container which is substantially completely removed out of the chamber and to make possible earliest intervention to the items provided therein. It becomes possible to close the door by means of the recess of the prevention wall.

In a probable embodiment of the present invention, the prevention element comprises a fixing section provided at the lower edge of the prevention element. Thus, the lower edge can be fixed in order to exert force against any item which is provided inside the container and which contacts and exerts a force on the prevention element.

A probable fixing section begins from the lower edge, and it may be a plate extending substantially parallel with respect to the movement direction of the container. The fixing section may cover the unused section of the upper opening of the container while it is in closed position (while it is in resting position).

In a probable embodiment of the present invention, the fixing section comprises a side fixing section connected with a side wall of the chamber. Thus, connection is provided to the chamber wall which is relatively the most fixed point inside the chamber, and a resistant prevention element can be provided. For instance, it can be provided at the sections of the fixing section which face the chamber walls provided at the vicinity thereof. A side fixing section can be provided by bending or folding the edge of the prevention element which is close to the chamber wall. By means of this, the costs like production, material, labor and storing costs are reduced.

In another probable embodiment of the present invention, the fixing section comprises an upper fixing section connected with an upper wall of the chamber. Thus, connection is provided to the chamber wall which is relatively the most fixed point inside the chamber, and a resistant prevention element can be obtained. By means of fixing to the upper wall, the volume, remaining under the upper wall of the chamber, can be used in an effective manner. Containers with various volumes can be used with the same prevention element.

The upper fixing section can be an element extending between the chamber upper wall and the fixing section. Functionally, an element can be embodied which keeps the fixing section suspended in a connected manner to the upper wall of the chamber. In order to keep the material cost at a low level, the material may be a strip plate or a shaft. In order to keep the fixing section suspended, a hanger section can be provided in the fixing section. The hanger section can be an opening provided in the fixing section which is in plate form.

In another probable embodiment of the present invention, the upper fixing section comprises a folding line configuring the upper fixing section at least in L form, and comprises a strength element provided on the folding line and maintaining shape of the upper fixing section. Thus, said strip plate embodiment can be used in a resistant manner. The folding line may extend along the width of a strip plate. The strength element can be a recess extending orthogonally with respect to the folding line for a strip plate comprising at least one folding line.

In another probable embodiment of the present invention, the upper fixing section comprises an end providing connection with the fixing section. Thus, an upper fixing section can be provided which can be connected to the hanger section in a rapid and easy manner. In a probable embodiment, the fixing section can comprise a housing accommodating the end of the upper fixing section therein. Thus, the assembly process can be provided in an easy and rapid manner. The housing can be an opening which is provided for instance in the hanger section. The end can be an extension which can be inserted into the opening provided in the hanger section. For instance, it may be a folded end of the upper fixing element in strip plate form. There may be a strength element in the folding line providing formation of end. The end and the fixing section can be fixed by means of an element like screw, rivet, etc.

In another probable embodiment of the present invention, the upper fixing section comprises a fixing hole providing a point connection with the upper wall of the chamber, and comprises a support wall parallel to axis of the fixing hole. Thus, the connection between the upper fixing section and the upper wall of the chamber can be provided in a rapid and low-cost manner. By means of the support wall, the rotational movement around the fixing hole due to the point connection can be prevented. The support wall may rest onto a suitable wall on the upper wall of the chamber, and thus it may support the preservation of the position of the upper fixing section. The support wall can be provided by means of bending or folding of the end of the upper fixing section, which is in strip plate form, which is close to the upper wall.

In another probable embodiment of the present invention, the chamber comprises a connection element fixed to the wall of the chamber and fixed to the edge of the prevention element being neighbor to the wall. Thus, the fixing and assembly process can be realized in a rapid and easy manner. In a probable embodiment, the connection element comprises housing for an upper edge of the prevention element. Thus, the upper edge of the prevention element can be supported or carried by the chamber wall without using an external fixing element.

The connection element can be obtained from plastic or a similar material. The connection element may comprise a connection section providing the connection thereof to the chamber wall. The connection section may comprise a base, a wall rising from the base and a locking element extending from the wall towards the base at a determined angle. The connection section may comprise a flexible locking element. The base and/or locking element may be embodied and/or formed in a manner permitting bending movement of the locking element. Thus, by providing a wide base, the connection of the connection section to the body of the connection element can be rigid.

The housing, provided in the connection element, can be provided between the chamber wall and an end extending in step form from a wall of the connection element which contacts the chamber wall.

The chamber upper wall may be a cover hiding an evaporator fixed to the upper wall of the chamber.

THE DETAILED DESCRIPTION OF THE INVENTION

Figure 1:
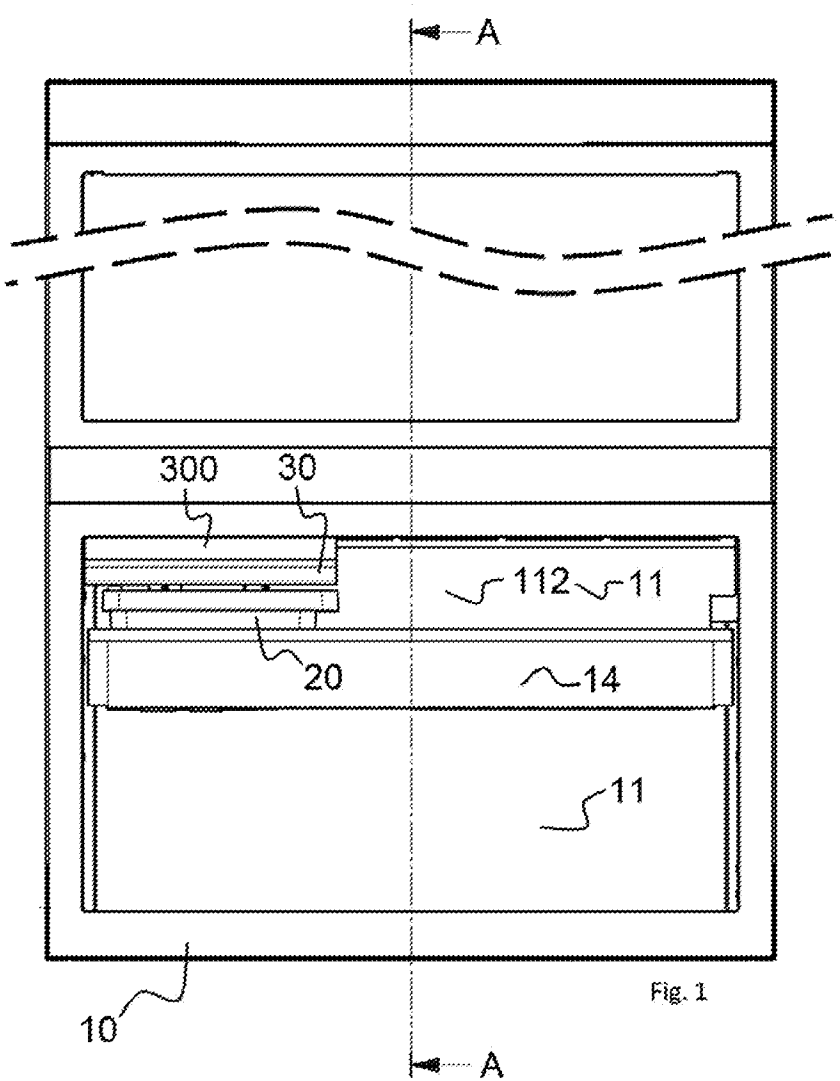
In FIG. 1, the frontal view of a probable cooling device is given. The door of the cooling device and the sections of the cooling device which are not related to the present invention have not been illustrated.

In this specification, the direction statements like front, top and bottom are described by referring the visible section of the cooling device (1), presented in FIG. 1, as the "front". Below, one or more than one of the probable embodiments of the present invention is described as example in a detailed manner.

In FIG. 1, the frontal view of a probable cooling device (1) is given. The cooling device (1) illustrated in the figure is a domestic refrigerator with two compartments where the lower compartment is used as the freezer and where the upper compartment is used as the cooling compartment. In order to focus on the lower compartment where the present invention is provided, a major part of the upper compartment is removed from the figure. The upper compartment is covered by a hinged door (13). The lower compartment is covered by a door (13) drawn like a drawer. In FIG. 1, doors (13) are not illustrated.

In a probable embodiment, the chamber (10) is the whole of the freezer. The container (2) is a vessel wherein the ice formed in an ice making unit (15) provided inside the freezer is accumulated. The ice making unit (15) is fixed to the upper wall (112) of the chamber (10) and to the left edge thereof. The container (2) is positioned to a drawer (14) extending between mutual side walls (110) of the chamber (10). The container (2) is positioned in the drawer (14) so as to correspond under the ice making unit (15) when the drawer (14) is in closed position. The container (2) comprises a base and rising walls (20) encircling the four sides of the base; and the opening provided at the upper side of the container (2), while it is inside the drawer (14) in closed position, faces the upper wall (112) of the chamber (10).

The prevention element (3) is positioned so as to correspond to the front of the ice making unit (15) and so as to remain between the container (2) and the upper wall (112) of the chamber (10).

Figure 2:
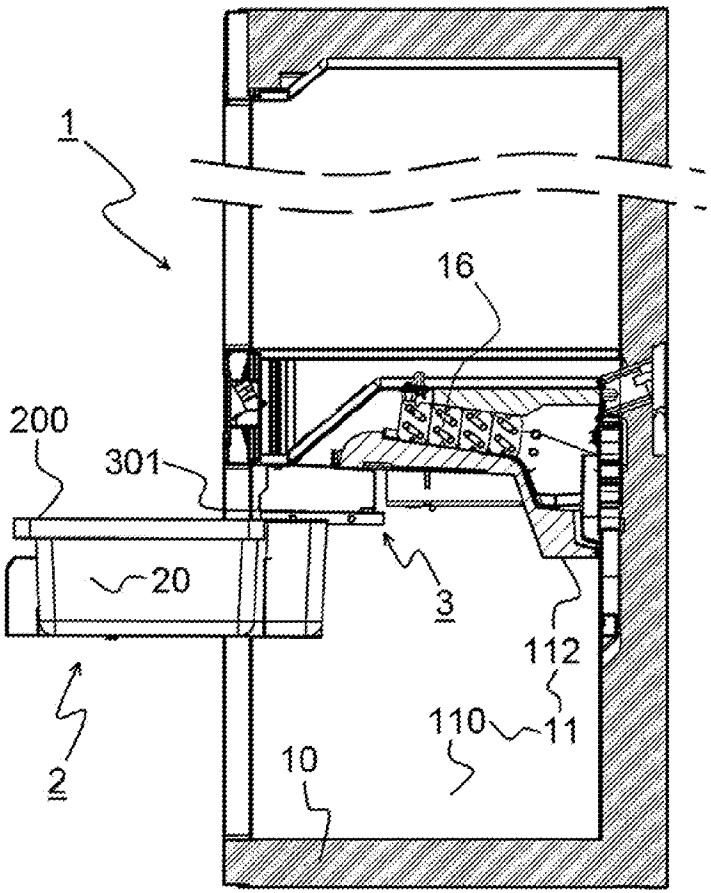
In FIG. 2, the section A-A obtained from FIG. 1 is illustrated. The container has been drawn out of the chamber.

In FIG. 2, the section of the cooling device (1) taken from FIG. 1 is illustrated. However, the drawer (14) is in a position drawn from the chamber (10). In the figure, the right side view of the container (2) is given. There is an evaporator (16) at the inner upper region of the chamber (10). There is an evaporator cover (17) just under the evaporator (16). The evaporator cover (17) hides the evaporator (16). The evaporator cover (17) partially covers the upper section of the chamber (10). Therefore, in the below mentioned description and in the following figures, it is also illustrated as the upper wall (112) since it is an element forming the upper wall (112) of the chamber (10).

Figure 3:
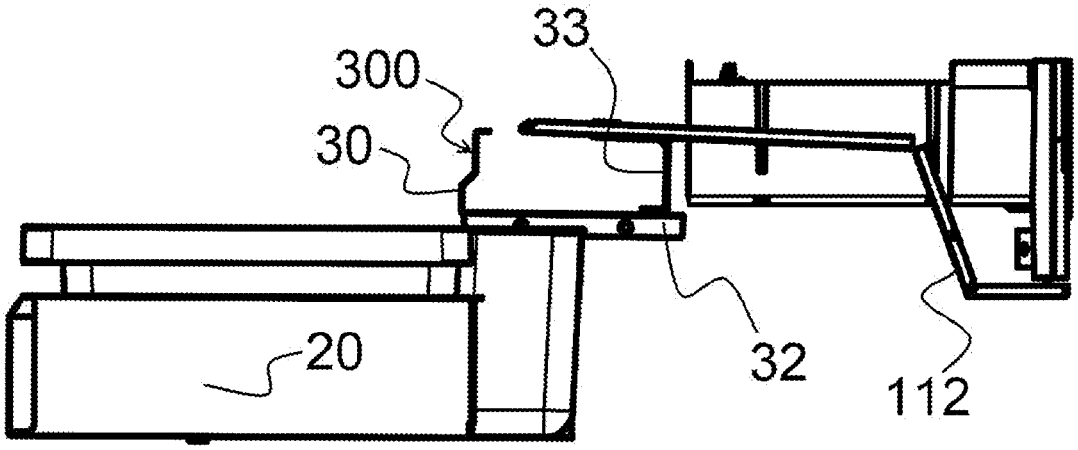
In FIG. 3, the container, the prevention element and the upper wall of the present invention are illustrated. The container is in the same position as in FIG. 2.

In FIG. 3, only the drawer (14), the container (2), the prevention element (3), the ice making unit (15) and the evaporator cover (17) are illustrated after the drawer (14) has been drawn out of the chamber (10). As partially illustrated in the figure, the prevention element (3) is connected to the side wall (110) of the chamber (10) by means of a side fixing section (32), and it is connected to the upper wall (112) of the chamber (10) by means of the upper fixing section (33). A prevention wall (30) is provided at the section of the prevention element (3) facing outside of the chamber (10). The lower edge (301) of the prevention wall (30) is provided at a position closest to the upper edge (200) of the container (2) in a non-contacting manner.

Figure 4:
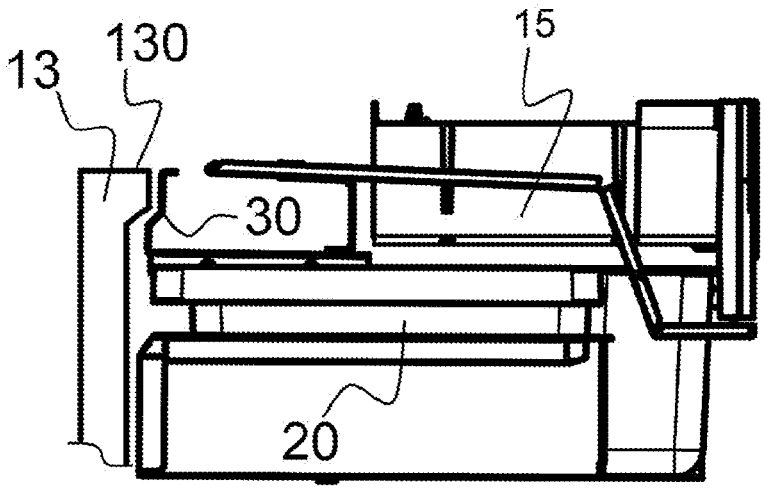
In FIG. 4, the condition of the container is illustrated where the container is in resting position. The door of the cooling device is in closed position.

In FIG. 4, a representative view of the door (13) is given. The door (13) and the drawer (14) are in closed position. Due to the form provided at the edge (130) of the door (13), a recess (300), which is compliant to this form, is provided on the prevention wall (30). When the drawer (14) is in closed position, there is the prevention element (3) on the front region of the container (2), and there is the ice making unit (15) on the rear region. Thus, the ice pieces formed in the ice making unit (15) are filled into the container (2).

Figure 5:
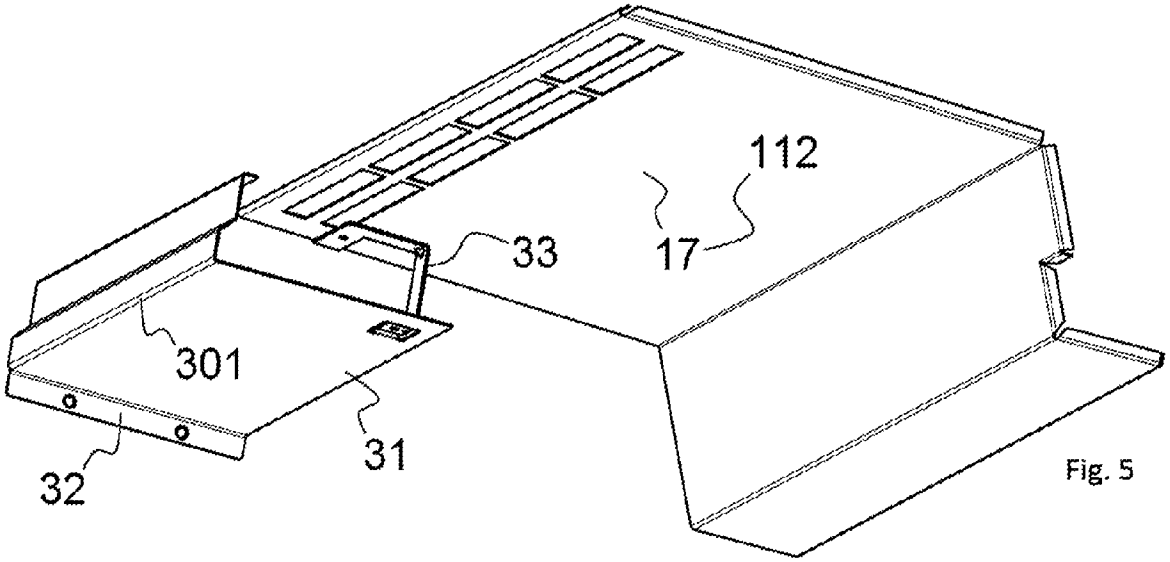
In FIG. 5, the isometric view of the prevention element and of the evaporator cover is given from the front-right region.
Figure 6:
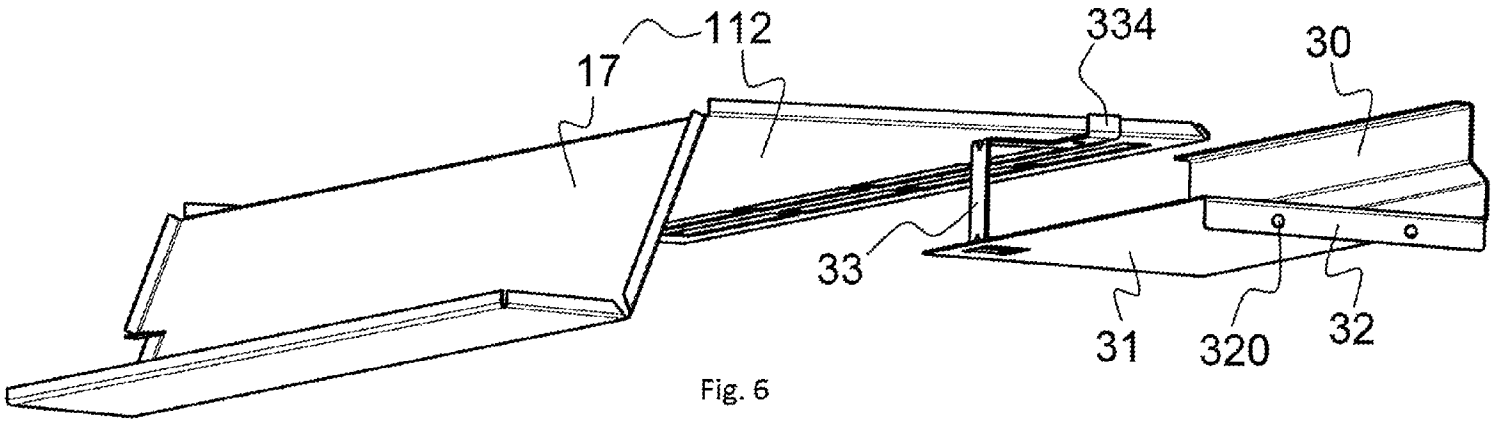
In FIG. 6, the isometric view of the prevention element and of the evaporator cover is given from the rear-left region.

In FIG. 5, the frontal isometric view of the prevention element (3) and of the evaporator cover (17) used as the upper wall (112) is given. In FIG. 6, the rear isometric view of the same pieces is given.

The prevention element (3) is obtained from a metal plate. First of all, the plate is bent by means of a folding process which is approximately at 90 degrees. Thus, a fixing section (31) is provided extending parallel with respect to the upper edge (200) of the container (2) and the prevention wall (30). The edge of the fixing section (31) which is close to the side wall (110) of the chamber (10) is folded downwardly approximately by 90 degrees. This folded section forms the side fixing section (32). One or more than one connection channel (320) is provided on the side fixing section (32). Thus, the first fixation is realized on the side wall (110) by means of a connection element like screw, etc.

A hanger section (310) is provided at the region of the fixing section (31) which is far from the side wall (110). The hanger section (310) is provided by means of raising the intermediate section provided between the two parallel cutouts provided on the plate forming the fixing section (31). The intermediate section is integrated to the plate, and it is approximately parallel with respect to the remaining section of the plate, however, it is provided slightly upwards. By means of this, the intermediate section provides formation of a slot (311) between itself and the plate. The slot (311) is used by the upper fixing section (33).

Figure 7:
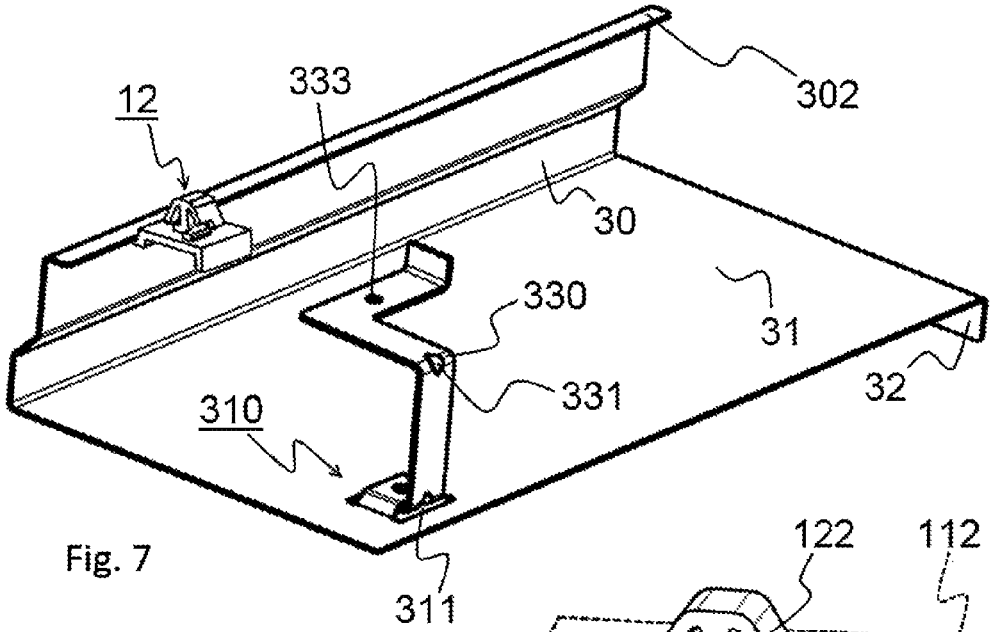
In FIG. 7, the isometric view of the prevention element and of the connection element is given from the rear-right region.

The upper fixing section (33), presented in FIG. 7, is basically a metal strip plate. The strip plate has an L-form section which contacts the upper wall (112) and which is parallel with respect to the upper wall (112). An arm of the L-form is fixed to the evaporator cover (17) by means of a fixing hole (333) and by means of a connection element (screw, bolt, etc.). The end of the arm having the fixing hole (333) is folded upwardly approximately by 90 degrees. Thus, it is rested onto the edge of the evaporator cover (17), and it prevents the upper fixing section (33) from making rotational movement around the fixing hole (333) axis. The other arm of the L-form forms the upper section of a strip plate which is in C-form when viewed from the side. The sections which are in L and C form are in integrated form. The lower section of the C form is positioned to the slot (311) provided in the hanger section (310) and it is fixed by means of a connection element (screw, bolt, etc.). Two folding lines (330) are formed on the strip plate in order to provide the C form. In order to increase the strength of these two folding lines (330), one each strength elements (331) are formed. The strength element (331) is a recess formed on the folding line (330). The recess can be obtained by means of deforming the folding line (330) by means of a force exerted to the folding line (330).

Figure 8:
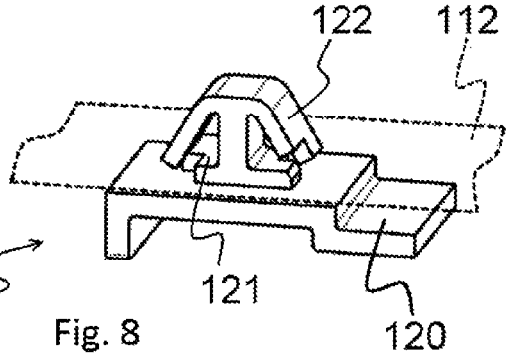
In FIG. 8, the isometric view of the connection element is given from the front-left region.
Figure 9:
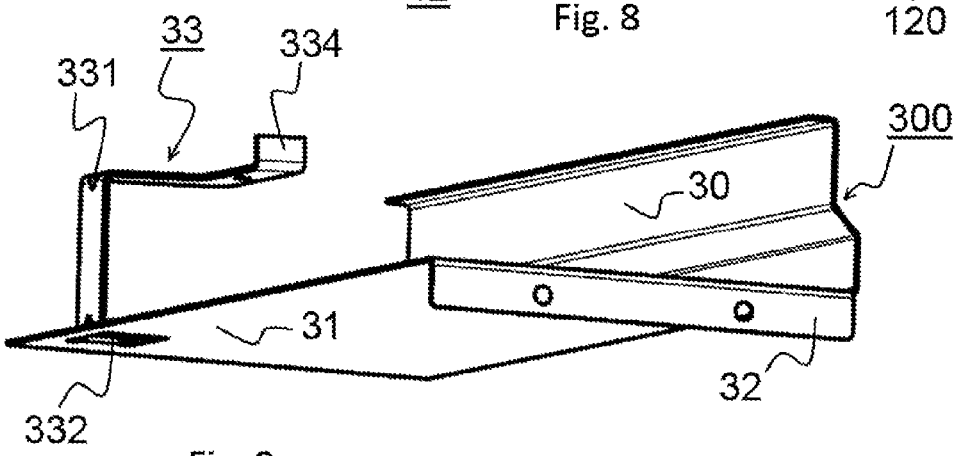
In FIG. 9, the isometric view of the prevention element is given from the rear-left region.

As exemplified in FIG. 9, the prevention wall (30) is bent twice, namely it is bent backwardly and again upwardly in a manner providing a recess (300) which is compliant to the form provided at the edge (130) of the door (13). The upper edge (302) of the prevention wall (30) is folded backwardly approximately by 90 degrees. The upper edge (302) is placed to a housing (120) provided by means of a connection element (12) fixed to the upper wall (112). The connection element (12) presented in FIG. 8 is preferably a plastic piece. The connection element (12) is generally in plate form. The connection element (12) has a connection section connected to a hole provided on the upper wall (112). The connection section comprises a base (121), and a locking element (122) provided on the base (121). The locking element (122) comprises two angled walls provided at two sides of a wall extending orthogonally upwardly from the base (121). The angled walls can bend at the end of the vertical wall and they can move. While the locking elements (122) enter into the hole provided on the upper wall (112), they bend and permit passage, however, after the passage is completed, they return to the prior positions thereof, and they prevent the connection element (12) from separating from the upper wall (112). In order for the bending movement of the locking element (122) not to be obstructed by the base (121), the ends of the locking elements (122) and of the base (121) which are close to each other have a stepped form like the jigsaw pieces which complete each other (FIG. 8). When the connection section is placed to the hole provided on the upper wall (112), some section of the connection element (12) contacts the upper wall (112). On the front edge of the connection element (12) which is in plate form, there is a wall extending downwardly, and there is one more wall extending frontally from said wall and in a parallel manner with respect to the upper wall (112). By means of this, said housing (120), wherein the upper edge (302) of the prevention element (3) is placed, is formed between the upper wall (112) and the connection element (12).

The prevention element (3), which is completely fixed, pushes the ice pieces, which rise up to a point which is higher than the upper edge (200) of the container (2) drawn outside of the chamber (10), into the container (2) again together with the lower edge (301) of the prevention element (3). Thus, ice pieces do not drop into the chamber (10), particularly they do not drop into the back of the drawer (14).

REFERENCE NUMBERS

| | |
|---|---|
| 1. Cooling device | 3. Prevention element |
| 10. Chamber | 30. Prevention wall |
| 11. Wall | 300. Recess |
| 110. Side wall | 301. Lower edge |
| 112. Upper wall | 302. Upper edge |
| 12. Connection element | 31. Fixing section |
| 120. Housing | 310. Hanger section |
| 121. Base | 311. Slot |
| 122. Locking element | 32. Side fixing section |
| 13. Door | 320. Connection channel |
| 130. Edge | 33. Upper fixing section |
| 14. Drawer | 330. Folding line |
| 15. Ice making unit | 331. Strength element |
| 16. Evaporator | 332. End |
| 17. Evaporator cover | 333. Fixing hole |
| 2. Container | 334. Support wall |
| 20. Wall | |
| 200. Upper edge | |

The invention claimed is:

1. A cooling device comprising a chamber adapted to chill an item; a container movably disposed in the chamber and having a wall; and wherein the chamber comprises a prevention element disposed on a wall of the chamber and having a lower edge being close to an upper edge of the wall of the container such that the movement of the container below the prevention element is possible and dropping of the item in the container over the wall of the container is prevented;

wherein the container includes an opening at its upper side, adapted to receive the item while the container is in a closed position.

2. A cooling device according to claim 1; wherein the wall of the container is a rear wall and/or a side wall of the container.

3. A cooling device according to claim 1; wherein the prevention element comprises a prevention wall having the lower edge.

4. A cooling device according to claim 3; wherein the prevention wall comprises a recess compliant with an edge of a door of the cooling device in form.

5. A cooling device according to claim 1; wherein the prevention element is a plate formed.

6. A cooling device according to claim 1; wherein the prevention element comprises a fixing section provided at the lower edge of the prevention element.

7. A cooling device according to claim 6; wherein the fixing section comprises a side fixing section connected with a side wall of the chamber.

8. A cooling device according to claim 6; wherein the fixing section comprises an upper fixing section connected with an upper wall of the chamber.

9. A cooling device according to claim 8; wherein the upper fixing section comprises a folding line configuring the upper fixing section at least in L form, and comprises a strength element provided on the folding line and maintaining shape of the upper fixing section.

10. A cooling device according to claim 8; wherein the upper fixing section comprises an end providing connection with the fixing section.

11. A cooling device according to claim 10; wherein the fixing section comprises a slot disposing the end of the upper fixing section.

12. A cooling device according to claim 8; wherein the upper fixing section comprises a fixing hole providing a point connection with the upper wall of the chamber, and comprises a support wall parallel to axis of the fixing hole.

13. A cooling device according to claim 1; wherein the chamber comprises a connection element fixed to the wall of the chamber and fixed to the edge of the prevention element being neighbor to the wall.

14. A cooling device according to claim 13; wherein the connection element comprises a housing for the upper edge of the prevention element.

15. A cooling device according to claim 1; wherein the item in the container prevented being dropped over the wall of the container is ice.

16. A cooling device according to claim 1 further comprising an ice making unit, wherein the opening of the container is in registration with ice dispensed from the ice making unit, when the container is in the closed position.

17. A cooling device according to claim 16 wherein the prevention element covers a front portion of the container and the opening is positioned at the rear portion of the container when the container is in the closed position.

18. A cooling device according to claim 1 further comprising a retractable drawer to hold the container, wherein the opening of the container is positioned to receive ice from an ice making unit when the drawer is in a closed position.

19. A cooling device comprising a chillable chamber; a container movably disposed in the chamber and having a wall; and wherein the chamber comprises a prevention element disposed on a wall of the chamber and having a lower edge being close to an upper edge of the wall of the container such that the movement of the container below the prevention element is possible and dropping of an item in the container over the wall of the container is prevented; wherein the prevention element comprises a prevention wall having the lower edge, and wherein the prevention wall comprises a recess compliant with an edge of a door of the cooling device in form.

20. A cooling device comprising a chillable chamber; a container movably disposed in the chamber and having a wall; and wherein the chamber comprises a prevention element disposed on a wall of the chamber and having a lower edge proximate to an upper edge of the wall of the container such that the movement of the container below the prevention element is possible and dropping of an item in the container over the wall of the container is prevented; wherein the prevention element comprises a fixing section provided at the lower edge of the prevention element; wherein the fixing section comprises an upper fixing section connected with an upper wall of the chamber; and wherein the upper fixing section comprises an end providing connection with the fixing section.

* * * * *